US006833064B2

(12) United States Patent
Berlowitz et al.

(10) Patent No.: US 6,833,064 B2
(45) Date of Patent: Dec. 21, 2004

(54) WIDE CUT FISCHER TROPSCH DIESEL FUELS

(75) Inventors: Paul Joseph Berlowitz, Glen Gardner, NJ (US); Robert Jay Wittenbrink, Kingwood, TX (US); Daniel Francis Ryan, Baton Rouge, LA (US); William Berlin Genetti, Baton Rouge, LA (US); Jack Wayne Johnson, Clinton, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 15 days.

(21) Appl. No.: 09/922,321

(22) Filed: Aug. 3, 2001

(65) Prior Publication Data

US 2002/0062053 A1 May 23, 2002

Related U.S. Application Data

(63) Continuation-in-part of application No. 09/562,454, filed on May 2, 2000, now abandoned.

(51) Int. Cl.[7] ..... C10L 1/04

(52) U.S. Cl. ..... 208/15; 208/17; 208/78; 208/80; 208/950

(58) Field of Search ..... 208/15, 17, 78, 208/80, 950, 27, 137, 141; 585/734, 733, 737; 44/436, 452; 518/700, 703, 704

(56) References Cited

U.S. PATENT DOCUMENTS

| | | | | |
|---|---|---|---|---|
| 4,684,756 A | * | 8/1987 | Derr et al. | 585/330 |
| 5,059,299 A | * | 10/1991 | Cody et al. | 208/27 |
| 5,324,335 A | | 6/1994 | Benham et al. | 44/452 |
| 5,348,982 A | | 9/1994 | Herbolzheimer et al. | 518/700 |
| 5,378,348 A | | 1/1995 | Davis et al. | 208/27 |
| 5,506,272 A | | 4/1996 | Benham et al. | 518/700 |
| 5,689,031 A | | 11/1997 | Berlowitz et al. | 585/734 |
| 5,723,716 A | | 3/1998 | Brandes et al. | 585/734 |
| 5,770,542 A | | 6/1998 | Brandes et al. | 502/527 |
| 5,792,339 A | | 8/1998 | Russell | 208/15 |
| 5,807,413 A | | 9/1998 | Wittenbrink et al. | 44/451 |
| 6,013,171 A | * | 1/2000 | Cook et al. | 208/27 |
| 6,179,994 B1 | * | 1/2001 | Clark et al. | 208/27 |
| 6,475,375 B1 | * | 11/2002 | Dancuart | 208/78 |

FOREIGN PATENT DOCUMENTS

| | | | | |
|---|---|---|---|---|
| EP | 0687289 B1 | | 12/1998 | C10L/1/22 |
| WO | WO-9214804 | * | 9/1992 | |
| WO | WO-9805740 | * | 2/1998 | |
| WO | WO99/13031 | | 3/1999 | C10L/1/32 |
| WO | WO-0012654 A | * | 3/2000 | |
| WO | WO-00 20535 | * | 4/2000 | |

OTHER PUBLICATIONS

Jimell Erwin et al, Southwest Research Institute, "The Standing of Fischer–Tropsch Diesel in an Assay of Fuel Performance and Emissions", Nov. 26, 1991–Oct. 26, 1993, pp. 1015–1053, NREL SUB YZ–2–113215–1.

(List continued on next page.)

*Primary Examiner*—Cephia D. Toomer
(74) *Attorney, Agent, or Firm*—Jay Simon; Mark D. Marin

(57) ABSTRACT

A wide cut Fischer-Tropsch derived diesel fuel is produced wherein the distillate boils in a wider range than a conventional diesel fuel while providing favorable low temperature properties and environmentally beneficial effects. In particular, the fuel comprises a hydrocarbon distillate derived from the Fischer-Tropsch process having T90 greater than 640° F. (338° C.) but less than 1000° F. (538° C.) and a cold filter plugging point less than or equal to +5° C.

14 Claims, 1 Drawing Sheet

OTHER PUBLICATIONS

"Standard Specification for Diesel Fuel Oils", ASTM Designation: D 975–98B, pp. 1–18, date unknown.

"European Programme on Emissions, Fuels and Engine Technologies", ACEA, Europia, Executive Summary, Jul. 1995, pp. 1–12.

T. W. Ryan III et al, Southwest Research Institute, "Diesel Fuel Composition Effects on Ignition and Emissions", 932735, pp. 77–94, date unknown.

K. B. Spreen et al, Southwest Research Institute, "Effects of Cetane Number, Aromatics, and Oxygenates on Emissions From a 1994 Heavy–Duty Diesel Engine With Exhaust Catalyst", 950250, pp. 238–254.

T. L. Ullman et al, Southwest Research Institute, "Effects of Cetane Number on Emissions From A Prototype 1998 Heavy–Duty Diesel Engine", 950251, pp. 255–271.

M. Signer et al, "European Programme on Emissions, Fuels and Engine Technologies (EPEFE)—Heavy Duty Diesel Study", 961074, pp. 564–579, date unknown.

D. J. Rickeard et al, "European Programme on Emissions, Fuels and Engine Technologies (EPEFE)—Comparison of Light and Heavy Duty Diesel Studies", 961075, pp. 580–599, date unknown.

M. Hublin et al, "European Programmes on Emissions, Fuels and Engine Technologies (EPEFE)—Light Duty Diesel Study", 961073, SAE Technical Paper Series, May 6–8, 1996, pp. 1–37.

P. W. Schaberg, I. S. Myburgh, J. J. Botha, P. N. Roets, C. L. Viljoen, L. P. Dancuart, M. E. Starr; "Diesel Exhaust Emissions Using Sasoi Slurry Phase Distillate Process Fuels", SAE 972898, International Fall Fuels & Lubricants Meeting & Exposition, Oct. 13–16, 1997, pp. 123–138.

B. Martin, P. Aakko, D. Beckman, N. Del Giacomo, F. Giavazzi: "Influence of Future Fuel Formulations on Diesel Engine Emissions—A Joint European Study", SAE 972966, International Fall Fuels & Lubricants Meeting & Exposition, Oct. 13–16, 1997, pp. 97–109.

N. Mann, F. Kvinge, G. Wilson; "Diesel Fuel Effects on Emissions: Towards a Better Understanding", SAE, 982486, International Fall Fuels and Lubricants Meeting and Exposition,Oct. 19–22, 1998; pp. 1–14.

M. H. McMillian, M. Gautam: "Consideration for Fischer-Tropsch Derived Liquid Fuels as a Fuel Injection Emission Control Parameter", SAE 982489; International Fall Fuels and Lubricants Meeting and Exposition, Oct. 19–22, 1998, pp. 1–11.

P. Norton, K. Vertin, B. Bailey, N. N. Clark, D. W. Lyons, S. Goguen, J. Eberhardt; "Emissions from Trucks using Fischer–Tropsch Diesel Fuel", SAE 982526, International Fall Fuels and Lubricants Meeting and Exposition, Oct. 19–22, 1998, pp. 1–10.

F. Payri, J. Arregle, C. Fenollosa, G. Belot, A. Delage, P. Schaberg, I. S. Myburgh, J. J. Botha; "Characterisation of the Injection–Combustion Process in a Common Rail D.I. Diesel Engine Running with Sasol Fischer–Tropsch Fuel"; SAE 2000–01–1803; International Spring Fuels & Lubricants Meeting & Exposition, Jun. 19–22, 2000, pp. 1–10.

M. B. Sirman, E. C. Owens, K. A. Whitney; "Emissions Comparison of Alternative Fuels in an Advanced Automotive Diesel Engine", SAE 2000–01–2048; International Spring Fuels & Lubricants Meeting & Exposition, Jun. 19–22, 2000, pp. 1–11.

* cited by examiner

WIDE CUT FISCHER TROPSCH DIESEL FUELS

This application is a Continuation-in-Part of and claims benefit of U.S. Ser. No. 09/562,454, filed May 2, 2000, now abandoned.

FIELD OF THE INVENTION

This invention relates to a distillate fuel derived from the Fischer-Tropsch process, and useful as a diesel fuel. More particularly, this invention relates to a wide cut Fischer-Tropsch derived diesel fuel wherein the distillate boils in a wider range than a conventional diesel fuel while providing favorable low temperature properties and environmentally beneficial effects.

BACKGROUND

For conventional distillate fuels, e.g., diesel fuels, the final boiling point is determined by a number of factors, including the engines ability to properly combust the tail end of the fuel, density, sulfur and polyaromatic content. These factors increase as end boiling point and T95 (the temperature at which most all the material has boiled off leaving only 5% remaining in the distillation pot) increase and have been shown to have a detrimental effect on emissions. For example, see the Coordinating Research Council (CRC) study on heavy duty diesels in the United States reported in SAE papers 932735, 950250 and 950251, and the European Programme on Emissions, Fuels and Engine Technologies (EPEFE) study on light and heavy duty diesels reported in SAE papers 961069, 961074 and 961075.

The cold filter plugging point (CFPP) is a standard property of oils. IP-309 is an Institute of Petroleum (61 New Cavendish St., London, W.I., England) standard test for cold filter plugging point (CFPP). A similar U.S. standard test is ASTM D6371.

In addition, heavier materials contained in the tail end of the fuel often lead to unfavorable cold flow properties, i.e., cold filter plugging point and cloud point. This is especially true of Fischer-Tropsch derived materials which are highly paraffinic. The heaviest paraffin molecules tend to crystallize as wax particles and precipitate above certain temperatures, resulting in high freeze point or cloud point, or both. Methods for improving cold flow properties of these fuels generally include undercutting the product and hydroisomerizing the distillate. The process of undercutting consists of eliminating the higher molecular weight materials which cause poor low temperature properties by lowering the upper boiling range (cut point) limits for a particular distillate fraction. However, undercutting is unattractive because it reduces the yield of high value marketable product and creates an abundance of off specification materials.

However, emissions measurements on Fischer-Tropsch derived diesel fuels, which have very low sulfur, aromatic and polyaromatic contents resulting in favorable emissions. A report by the Southwest Research Institute (SwRI) entitled "The Standing of Fischer-Tropsch Diesel in an Assay of Fuel Performance and Emissions" by Jimell Erwin and Thomas W. Ryan, III, NREL (National Renewable Energy Laboratory) Subcontract YZ-2-113215, October 1993, details the advantage of Fischer-Tropsch fuels for lowering emissions when used neat, that is, use of pure Fischer-Tropsch diesel fuels.

Presently, there remains a need to develop an economic distillate fuel, useful as a diesel fuel, which has lower emissions after combustion and allows a greater portion of the distillate to be used as a high value premium product. In particular, emissions of solid particulate matter (PM) and nitrogen oxides (NOx) are an important concern due to current and proposed environmental regulations. In this regard, the ability to incorporate the tail ends of a fuel into a diesel fuel while achieving favorable cold flow properties and lower emissions will provide a distinct economic advantage.

The citations of the several SAE papers referenced herein are:

P. J. Zemroch, P. Schimmering, G. Sado, C. T. Gray and Hans-Martin Burghardt, "*European Programme on Emissions, Fuels and Engine Technologies-Statistical Design and Analysis Techniques*", SAE paper 961069.

M. Signer, P. Heinze, R. Mercogliano and J. J. Stein, "*European Programme on Emissions, Fuels and Engine Technologies-Heavy Duty Diesel Study*", SAE paper 961074.

D. J. Rickeard, R. Bonetto and M. Signer,", "*European Programme on Emissions, Fuels and Engine Technologies-Comparison of Light and Heavy Duty Diesels*", SAE paper 961075.

K. B. Spreen, T. L. Ullman and R. L. Mason, "*Effects of Cetane Number, Aromatics and Oxygenates on Emissions from a* 1994 *Heavy-Duty Diesel Engine with Exhaust Catalyst*", SAE paper 950250.

K. B. Spreen, T. L. Ullman and R. L. Mason, "*Effects of Cetane Number on Emissions from a Prototype* 1998 *heavy Duty Diesel Engine*", SAE paper 950251.

Thomas Ryan III and Jimell Erwin, "*Diesel Fuel Composition Effect on Ignition and Emissions*", SAE paper 932735.

M. Hublin, P. G. Gadd, D. E. Hall, K. P. Schindler, "*European Programme on Emissions, Fuels and Engine Technologies-Light Duty Diesel Study*", SAE paper 961073.

SUMMARY OF THE INVENTION

In one embodiment, this invention relates to a wide cut fuel, useful as a diesel fuel, derived from the Fischer-Tropsch process, which reduces emissions and demonstrates favorable cold flow properties. In particular, the fuel comprises a hydrocarbon distillate derived from the Fischer-Tropsch process having a T90 (ASTM D-86) greater than 640° F. (338° C.) but less than 1000° F. (538° C.), preferably a T90 greater than 650° F. (343° C.) but less than 900° F. (482° C.), more preferably a T90 greater than 660° F. (349° C.) but less than 800° F. (427° C.), even more preferably a T90 greater than 660° F. (349° C.) but less than 700° F. (371° C.), and has a cloud point (ASTM D-2500-98*a*) and cold filter plugging point (CFPP) (IP-309) of less than 5° C., preferably less than −5° C., more preferably less than −15° C., still more preferably less than −30° C. wherein the fuel contains;

| | |
|---|---|
| Sulfur, Nitrogen | <10 wppm, preferably <5 wppm, more preferably <1 wppm, |
| Aromatics | <2 wt %, preferably <1 wt %, more preferably <0.1 wt % |
| Polyaromatics | <0.1 wt %, |
| Cetane number | >65, preferably >70, |
| Density | >0.78 |

Preferably, the fuel of this invention is produced by separating a wax containing Fischer-Tropsch derived product into a 300° F.+ distillate fraction which is further upgraded via hydroisomerization and selective catalytic dewaxing. In particular, a 300° F.+ (149° C.+) fraction derived from the Fischer-Tropsch process is passed into a first reaction zone, of two sequential isomerization reaction zones in a single reaction stage, the first reaction zone comprising a first catalyst containing a suitable hydroisomerization catalyst, to form a first zone effluent. At least a portion of the liquid product from the first zone effluent, preferably the entire liquid product from the first zone effluent, is passed into a second reaction zone, comprising a second catalyst having a catalytic dewaxing functionality, to form a second zone effluent. In the alternative, the second reaction zone may contain a mixture or composite comprising both catalytic dewaxing and hydroisomerization catalysts. The first and second zones may be in the same or separate reaction vessels and preferably both zones are contained in the same reaction vessel. Further, the first and/or second reaction zone may comprise one or more catalyst beds. The second zone effluent comprises an isomerized hydrocarbon product and can be fractionated into desired liquid product fractions, e.g., a 320–700° F. boiling fraction.

By 300° F.+ fraction is meant the fraction of the hydrocarbons synthesized by the Fischer-Tropsch process and boiling above a nominal 300° F. boiling point. At least a portion of the product of the second reaction zone is recovered to produce a middle distillate boiling in the diesel fuel range, i.e., a 320–700° F. boiling fraction. Preferably, the process is conducted in the absence of intermediate hydrotreating, and produces products with excellent cold flow characteristics, i.e., cloud and freeze point, superior smoke point and better than expected emissions characteristics.

A T90 for a typical diesel fuel is approximately 540° F.–640° F. (282° C.–338° C.), see ASTM D-975-98*b*. However, smoke levels, emissions and unfavorable cold flow properties generally increase with boiling temperature. See SAE 961073 and 961069. The fuel of this invention comprises a wide cut fuel which includes high end boiling fractions, but still demonstrates favorable cold flow properties while reducing emissions. In addition, the fuel of this invention reduces smoke levels during acceleration.

DETAILED DESCRIPTION OF THE INVENTION

Figure 1:
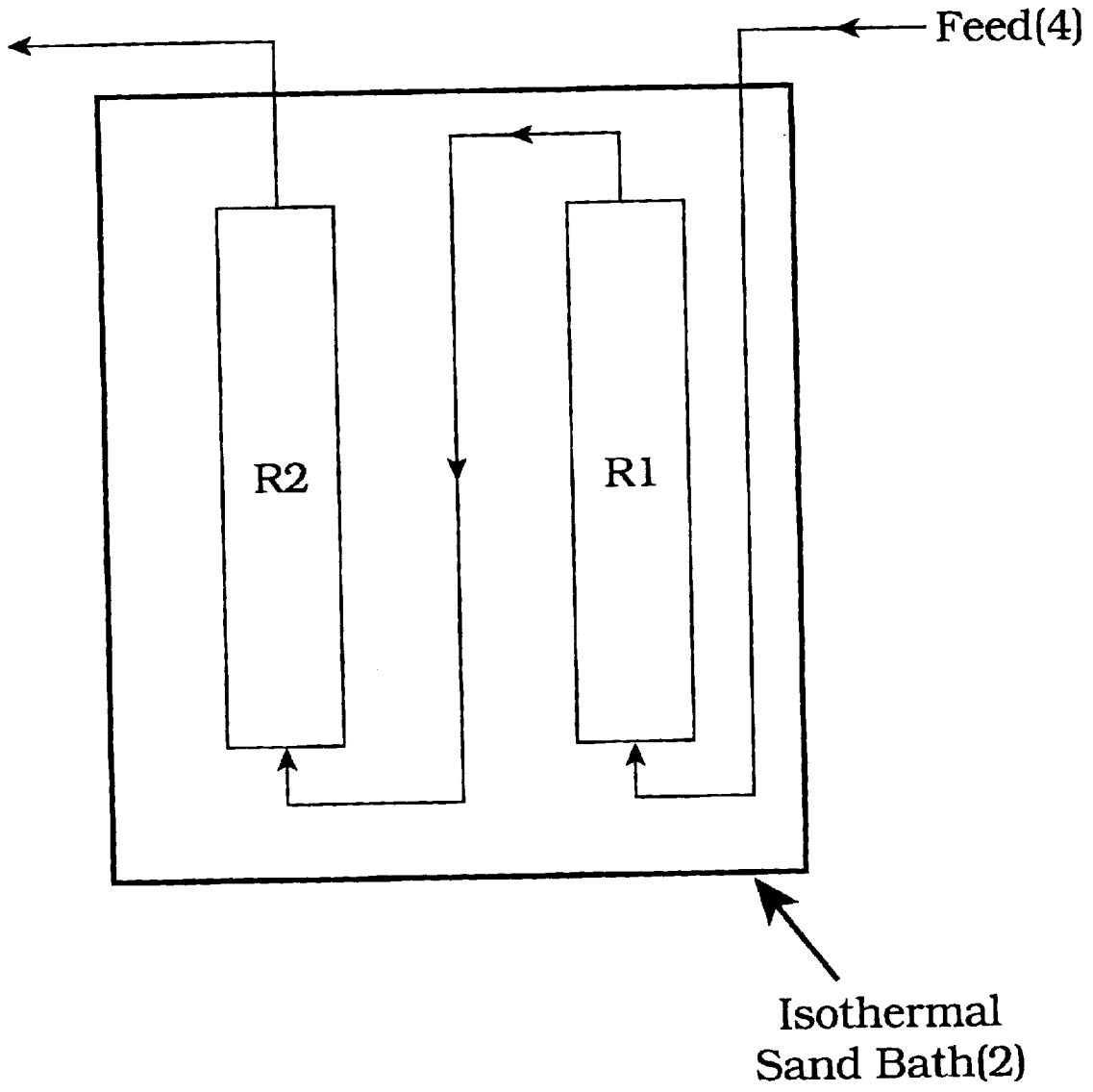
FIG. 1 is an illustration of the experimental reactor used to produce the comparative test fuel of this invention as described in the example.

The Fischer-Tropsch process is well known to those skilled in the art, see for example, U.S. Pat. Nos. 5,348,982 and 5,545,674 herein incorporated by reference. Typically, the Fischer-Tropsch process involves the reaction of a synthesis gas feed comprising hydrogen and carbon monoxide fed into a hydrocarbon synthesis reactor in the presence of a Fischer-Tropsch catalyst, generally a supported or unsupported Group VIII, non-noble metal e.g., Fe, Ni, Ru, Co and with or without a promoter e.g., ruthenium, rhenium and zirconium. These processes include fixed bed, fluid bed and slurry hydrocarbon synthesis. A preferred Fischer-Tropsch process is one that utilizes a non-shifting catalyst, such as cobalt or ruthenium or mixtures thereof, preferably cobalt, and preferably a promoted cobalt, the promoter being zirconium or rhenium, preferably rhenium. Such catalysts are well known and a preferred catalyst is described in U.S. Pat. No. 4,568,663 as well as European Patent 0 266 898. The synthesis gas feed used in the process comprises a mixture of $H_2$ and CO wherein $H_2$:CO are present in a ratio of at least about 1.7, preferably at least about 1.75, more preferably 1.75 to 2.5.

Regardless of the catalyst or conditions employed however, the high proportion of normal paraffins in the product produced by the Fischer-Tropsch process must be converted from wax containing hydrocarbon feeds into more useable products, such as transportation fuels. Thus, conversion is accomplished primarily by hydrogen treatments involving hydrotreating, hydroisomerization, and hydrocracking in which a suitable fraction of the product is contacted with a suitable catalyst in the presence of hydrogen to isomerize the fraction by converting the molecular structure of at least a portion of the hydrocarbon material from normal paraffins to branched iso-paraffins to form the desired product, as is known to those skilled in the art.

In accordance with an embodiment of the invention, a wax containing paraffin feed stock derived from the Fischer-Tropsch process is separated, usually by fractionation, into a 300° F.+ distillate fraction. The feed also comprises more than 90 wt % paraffinic hydrocarbons, most of which are normal paraffins. In addition, the feed preferably has negligible amounts of sulfur and nitrogen compounds with less than 2000 wppm, preferably less than 1000 wppm and more preferably less than 500 wppm of oxygen in the form of oxygenates.

Preferably, the 300° F.+ Fischer-Tropsch derived fraction is then upgraded via a single stage isomerization process, i.e., the liquid product of the first reaction zone is passed directly into the second reaction zone, comprising hydroisomerization followed by selective catalytic dewaxing. The single stage reduces product loss and avoids the need for two parallel reactions stages. In particular, the 300° F.+ distillate fraction is passed into a first reaction zone, comprising a hydroisomerization catalyst to form a first zone effluent wherein at least a portion of the liquid product of the first zone effluent is passed into a second reaction zone, comprising a catalyst having a catalytic dewaxing function, to form a second zone effluent comprising a hydroisomerized hydrocarbon product. Preferably, the entire liquid product existing under the conditions of the first reaction zone pass directly into the second reaction zone. However, the first zone effluent may also comprise light gases and naphtha which pass into the second reaction zone. In an alternate embodiment, the light gas and/or naphtha fractions may be separated before the first zone effluent is transferred to the second reaction zone. Further, additional hydrogen or other quench gases may be injected before passing the effluent of the first zone into the second reaction zone.

The Fischer-Tropsch derived wax containing feed is subjected to hydroisomerization in the first reaction zone in the presence of hydrogen, or a hydrogen containing gas, to convert a portion of the normal paraffins to isoparaffins. The degree of hydroisomerization is measured by the amount of boiling point conversion, i.e., the amount of 700° F.+ hydrocarbons converted to 700° F.– hydrocarbons. Following hydroisomerization in the first zone, at least a portion of the liquid product from the first zone effluent is passed into a second reaction zone containing a dewaxing catalyst, a hydroisomerization catalyst or a mixture thereof, designed to minimize boiling point conversion while improving cold flow/cloud point properties by reacting at least a portion of the remaining n-paraffins contained in the first zone effluent to further isomerize the n-paraffins to isoparaffins or crack larger chain paraffins to smaller chain paraffins which are, in turn, isomerized to iso-paraffins or selectively crack the n-paraffins. The dewaxing reaction within the second reaction zone is conducted until achieving a cold filter plugging point for the second zone effluent at or below about 5° C., preferably less than −5° C., more preferably less than −15° C., even more preferably less than −30° C. Using standard distillation techniques, a hydrocarbon product is recovered from the second zone effluent having a T90 (ASTM D-86) greater than 640° F. (338° C.) but less than 1000° F. (538° C.), preferably a T90 greater than 650° F. (343° C.) but less than 900° F. (482° C.), more preferably a T90 greater than 660° F. (349° C.) but less than 800° F. (427° C.), even more preferably a T90 greater than 660° F. (349° C.) but less than 700° F. (371° C.).

In this way, a wider than normal hydrocarbon distillate is recovered boiling above and/or below the boiling range of a typical diesel fuel thereby improving product yields, while maintaining favorable cold flow properties.

Hydroisomerization and hydrocracking are well known processes for upgrading hydrocarbon synthesis products and their conditions can vary widely. Accordingly, applicants' isomerization process may be employed in either a single stage or dual reactor system depending on the desired catalysts utilized for each reaction zone. In another embodiment of the present invention, hydroisomerization and catalytic dewaxing are conducted in a single stage, fixed bed reactor comprising a first and second reaction zone wherein a hydroisomerization catalyst and catalytic dewaxing catalyst operate to convert 10–80% of the 700° F.+ materials to 700° F.− materials and selectively dewax the feed to achieve a cold filter plugging point below about 5° C. The first reaction zone preferably comprises a first catalyst layer containing a hydroisomerization catalyst while the second reaction zone comprises a second catalyst layer containing a catalytic dewaxing catalyst or preferably containing a mixture of hydroisomerization and catalytic dewaxing catalysts. In addition, each reaction zone may contain one or more catalyst beds comprising one or more catalysts in order to incorporate interstage quench or liquid redistribution between beds. Catalyst activity for each reaction zone will normally be dependent upon variations in operating conditions. When operating in a single reactor, it is preferred to utilize hydroisomerization and catalytic dewaxing catalysts which have similar activity for the conversion and cracking of the n-paraffin containing hydrocarbon feeds under analogous operating conditions, i.e., similar or overlapping reaction conditions such as temperature and pressure. However, activity balance may be achieved by varying the degree and concentration of each of the catalysts in a single reactor or the degree and concentration of a catalyst within a particular reaction zone or catalyst bed. In the alternative, a dual reactor system may be employed to conduct hydroisomerization and catalytic dewaxing in separate reactors, connected in series, such that the total liquid product of the first reactor flows directly into the reaction zone of the second reactor. The preferred reactor conditions, i.e., temperature and pressure for each reactor, may depend on the catalysts employed in each reactor.

During hydroisomerization of the wax containing paraffinic feed, conversion of the 700° F.+ fraction to a material boiling below this range (700° F.−) will range from about 10–80%, preferably 30–70% and more preferably 30–60% based on a once through pass of the feed through the reaction zone. The feed will typically contain some 700° F.− material prior to hydroisomerization and at least a portion of this lower boiling material will also be converted into lower boiling components. Table 1 below lists some broad and preferred conditions for hydroisomerization in accordance with the preferred embodiment of Applicants invention.

TABLE 1

| CONDITION | BROAD RANGE | PREFERRED RANGE |
|---|---|---|
| Temperature | 400–750° F. | 600–750° F. |
| Pressure, psig | 0–2000 | 500–1200 |
| Hydrogen treat rate, SCF/B | 500–4000 | 1000–2000 |
| LHSV | 0.25–4.0 | 0.5–2.5 |

The hydroisomerization is achieved by reacting the wax containing feed with hydrogen in the presence of a suitable hydroisomerization catalyst. While many catalysts may be satisfactory for this step, some catalysts perform better than others and are preferred. For example, applicants preferred hydroisomerization catalyst comprises one or more Group VIII noble or non-noble metal components, and depending on the reaction conditions, one or more non-noble metals such as Co, Ni and Fe, which may or may not also include Group VIB metal (e.g., Mo, W) oxide promoters, supported on an acidic metal oxide support to give the catalyst both a hydrogenation and dehydrogenation function for activating the hydrocarbons and an acid function for isomerization. However, noble metals reduce hydrogenolysis, particularly at lower temperatures and will therefore be preferred for some applications. Preferred noble metals are Pt and Pd. The catalyst may also contain a Group IB metal, such as copper, as a hydrogenolysis suppressant. The cracking and hydrogenation activity of the catalyst is determined by its specific composition. The metal Groups referred to herein are those found in the Sargent-Welch Periodic Table of the Elements, copyright 1968.

The acidic support is preferably an amorphous silica-alumina where the silica is present in amounts of less than about 30 wt %, preferably 5–30 wt % more preferably 10–20 wt %. Additionally, the silica-alumina support may contain amounts of a binder for maintaining catalyst integrity during high temperature, high pressure processes. Typical binders include silica, alumina, Group IVA metal oxides, e.g., zirconia, titania, various types of clays, magnesia, etc., and mixtures of the foregoing, preferably alumina, silica, or zirconia, most preferably alumina. Binders, when present in the catalyst composition, make up about 5–50% by weight of the support, preferably 5–35% by weight, more preferably 20–30% by weight.

Characteristics of the support preferably include surface areas of 200–500 $m^2$ /gm (BET method), preferably about 250–400 $m^2$/gm; and pore volume of less than 1 ml/gm as determined by water adsorption, preferably in the range of about 0.35 to 0.8 m/gm, e.g., 0.57 ml/gm.

The metals may be incorporated onto the support by any suitable method, and the incipient wetness technique is preferred. Suitable metal solutions may be used, such as nickel nitrate, copper nitrate or other aqueous soluble salts. Preferably, the metals are co-impregnated onto the support allowing for intimate contact between the Group VIII metal and the Group IB metal, for example, the formation of bimetallic clusters. The impregnated support is then dried, e.g., over night at about 100–150° C., followed by calcination in air at temperatures ranging from about 200–550° C., preferably 350–550° C., so that there is no excessive loss of surface area or pore volume.

Group VIII metal concentrations of less than about 15 wt % based on total weight of catalyst, preferably about 1–12 wt %, more preferably about 1–10 wt % can be employed. The Group IB metal is usually present in lesser amounts and may range from about a 1:2 to about a 1:20 ratio respecting the Group VIII metal.

Some preferred catalyst characteristics are shown below:

| | |
|---|---|
| Ni, wt % | 2.5–3.5 |
| Cu, wt % | 0.25–0.35 |
| $Al_2O_3$—$SiO_2$ | 65–75 |
| $Al_2O_3$ (binder) | 25–35 |
| Surface Area, $m^2/g$ | 290–325 |
| Total Pore Volume (Hg), ml/g | 0.35–0.45 |
| Compacted Bulk Density, g/ml | 0.58–0.68 |
| Avg. Crush Strength | 3.0 min. |
| Loss on Ignition (1 hour @ 550° C.), % wt. | 3.0 max. |
| Abrasion loss @ 0.5 hr, wt % | 2.0 max. |
| Fines, wt % through 20 mesh | 1.0 max. |

Catalytic dewaxing, has as its objective, the removal of a portion of the remaining straight chain n-paraffins which contribute to undesirably high cloud point while minimizing the cracking of the branched chain iso-paraffins formed during hydroisomerization. In particular, this step removes the n-paraffins by either selectively breaking the n-paraffins into small molecules, lower-boiling liquids or converting some of the remaining n-paraffins to isoparaffins, while leaving the more branched chain iso-paraffins in the process stream. Catalytic dewaxing processes commonly employ zeolite dewaxing catalysts with a high degree of shape selectivity so that only linear (or almost liner) paraffins can enter the internal structure of the zeolite where they undergo cracking to effect their removal. Some preferred dewaxing catalysts include SAPO-11, SAPO-41, ZSM-22, ZSM-23, ZSM-35, ZSM-48, ZSM-57, SSZ-31, SSZ-32, SSZ-41, SSZ-43 and ferrierite.

The catalyst(s) contained in the second reaction zone having a catalytic dewaxing functionality may comprise a catalytic dewaxing catalyst, a mixture of a catalytic dewaxing catalyst and a hydroisomerization catalyst or a composite containing a catalytic dewaxing and hydroisomerization catalyst component. In the alternative, layered catalyst beds comprising catalytic dewaxing catalyst and/or hydroisomerization catalysts may be employed in the second reaction zone. Preferably, the dewaxing catalyst comprises a composite pellet comprising both a hydroisomerization catalyst and catalytic dewaxing catalyst.

Preferably, the dewaxing component of the catalytic dewaxing catalyst comprises a 10 member ring unidirectional, inorganic oxide, molecular sieve having generally oval 1-D pores having a minor axis between about 4.2 Å and about 4.8 Å and a major axis between about 5.4 Å and about 7.0 Å as determined by X-ray crystallography. The molecular sieve is preferably impregnated with from 0.1 to 5 wt %, more preferably about 0.1 to 3 wt % of at least one Group VIII metal, preferably a noble Group VIII metal, most preferably platinum or palladium.

The isomerization component of the composite catalyst can be any of the typical isomerization catalysts, such as those comprising a refractory metal oxide support base (e.g., alumina, silica-alumina, zirconia, titanium, etc.) on which has been deposited a catalytically active metal selected from the group consisting of Group VI B, Group VII B, Group VIII metals and mixtures thereof, preferably Group VIII, more preferably noble Group VIII, most preferably Pt or Pd and optionally including a promoter or dopant such as halogen, phosphorus, boron, yttria, magnesia, etc. preferably halogen, yttria or magnesia, most preferably fluorine. The catalytically active metals are present in the range 0.1 to 5 wt %, preferably 0.1 to 3 wt %, more preferably 0.1 to 2 wt %, most preferably 0.1 to 1 wt %. The promoters and dopants are used to control the acidity of the isomerization catalyst. Thus, when the isomerization catalyst employs a base material such as alumina, acidity is imparted to the catalyst by addition of a halogen, preferably fluorine. When a halogen is used, preferably fluorine, it is present in an amount in the range 0.1 to 10 wt %, preferably 0.1 to 3 wt %, more preferably 0.1 to 2 wt % most preferably 0.5 to 1.5 wt %. Similarly, if silica-alumina is used as the base material, acidity can be controlled by adjusting the ratio of silica to alumina or by adding a dopant such as yttria or magnesia which reduces the acidity of the silica-alumina base material as taught in U.S. Pat. No. 5,254,518. Similar to the dewaxing catalyst, one or more isomerization catalysts can be pulverized and powdered, and mixed producing the second component of the composite pellet catalyst.

The composite catalyst can contain the individual powdered components which make it up in a broad ratio. Thus, the components can be present in the ratio in the range 1:100 or more to 100 or more: 1, preferably 1:3 to 3:1.

A better illustration of the preferred embodiments of this invention may be had by the following comparisons and examples.

A wide cut Fischer-Tropsch derived hydrocarbon distillate was prepared as follows:

As illustrated in FIG. 1, a 300° F.+ Fischer-Tropsch derived wax containing feed (4) was run through two 0.5 inch up-flow fixed bed reactors, R1 and R2, connected in series and contained within an isothermal sand bath (2) where the total liquid product of the first reactor (R1) was fed directly into the reaction zone of the second reactor (R2).

R1 contained 80 cc (44.7 gms) of a commercially available hydroisomerization catalyst comprising 0.5 wt % Pd on a silica-alumina support containing nominally 20 wt % alumina/80 wt % silica and 30 wt % alumina binder. R2 contained a catalyst blend containing 29 cc (16.2 gms) of a commercially available dewaxing catalyst comprising 0.5 wt % Pt on an extrudate containing Theta-1 zeolite (TON) and 51 cc (27.5 gms) of the hydroisomerization catalyst contained in R1. The extrudate was crushed and the −8, +20 mesh used to load a portion of the fixed bed reactor. There was no treatment or interstage stripping of the hydroisomerized product of R1 prior to feeding into R2.

The 300° F.+ wax containing feed (4) was run through R1 at conditions that resulted in about 50% conversion of the 700° F.+ material to 700° F.− and dewaxing was run through R2 to achieve a cloud point for the product of R1 of less than −30° C. The isothermal reactor conditions were as follows: 715 psig, 1650 SCF/Bbl hydrogen treat rate at 0.854 LHSV and a temperature of approximately 606° F.

Product distribution from the process detailed above is shown in Table 2 below and the boiling point cuts used in the Fischer-Tropsch distillate are indicated as Fuel 1 and Fuel 2. The feed was obtained by reacting hydrogen and CO over a Fischer-Tropsch catalyst comprising cobalt and rhenium on a titania support. In particular, Fuel 1 comprised a wider than normal 280–800° F. Fischer-Tropsch derived hydrocarbon distillate fraction and Fuel 2 comprised a 280–900° F. fraction.

TABLE 2

| BOILING RANGE | YIELD, WT % | FUEL 1 | FUEL 2 |
|---|---|---|---|
| IBP–280° F. | 10.492 | No | No |
| 280–300° F. | 2.744 | Yes | Yes |
| 300–700° F. | 53.599 | Yes | Yes |
| 700–800° F. | 10.016 | Yes | Yes |
| 800° F.+ | 23.149 | No | Yes |

For emissions testing, the wide cut diesel fuel, as produced above, was compared with two conventional petroleum diesel fuels referred to hence as Fuel 3 and Fuel 4. In particular, Fuel 3 was a US #2 Low Sulfur Diesel Fuel (ASTM D975-98b) and Fuel 4 was a European Low Sulphur Automotive Diesel (LSADO) Table 3 below provides a comparison of the relevant characteristics for Fuels 1–4.

TABLE 3

| PROPERTY | FUEL 1 | FUEL 2 | FUEL 3 | FUEL 4 |
|---|---|---|---|---|
| Density (IP-365) | .778 | .785 | .846 | .854 |
| Sulfur, % (RD 86/10) | 0 | 0 | 0.04% | .05% |
| IBP,° C. (ASTM D-86) | 174 | 174 | 197 | 184 |
| T50,° C. (ASTM D-86) | 273 | 291 | 294 | 288 |
| T95,° C. (ASTM D-86) | 375 | 390 | 339 | 345 |
| Cetane (ASTM D-613) | 71.8 | — | 53.0 | 50.1 |
| Aromatics, total % (IP-391) | 0 | 0 | 27.9 | 26.7 |
| Polyaromatics, % (IP-391) | 0 | 0 | 7.1 | 6.4 |
| Cloud Point, ° C. (ASTM D-5771) | −33 | −10 | −6 | −5 |
| CFPP, ° C. (IP-309) | −33 | −15 | −7 | −18 |

Concentrations listed as "0" correspond to concentrations below the detectable limits of the test procedures delineated in Table 3. Each standard analytical technique used to determine the components of Fuels 1–4 is shown in parentheses.

By virtue of using the Fischer-Tropsch process, the recovered distillate has essentially nil sulfur and nitrogen. Further, the process does not make aromatics and polyaromatics, or as usually operated, virtually no aromatics are produced. Accordingly, the concentration of sulfur, aromatics and polyaromatics for Fuel 1 and 2 was below the detectable limits of the test methods shown in Table 3.

As illustrated in the data of Table 3, the fuels of the invention demonstrate favorable cold flow properties. Fuel 1 having a cloud point and cold filter plugging point of −33° C., significantly below those of the conventional fuels and Fuel 2 having a cloud point and cold filter plugging point of −10° C. and −15° C. respectively.

Engine Testing

For comparison, the wide cut diesel fuels of the invention (Fuel 1 and Fuel 2) were compared with the conventional petroleum fuels. The fuels were evaluated with a Peugeot 405 Indirect Injection (IDI) light duty diesel engine. Regulated emissions were measured during hot-start transient cycles and emissions of hydrocarbons (HC), carbon monoxide (CO), nitrous oxide (NOx) and particulate matter (PM) were measured. The results are summarized in Tables 4a and 4b below. Test data is represented as the absolute value in gm/Hp-hr which is followed by the percent change for each emission value verses the base, Fuel 4; a conventional petroleum diesel fuel. All fuels were run through the combined Urban Drive Cycle and Extra Urban Drive Cycle (commonly known as ECE-EUDC, respectively) hot and cold test protocols in duplicate in a randomized design.

The light duty European test cycle is performed in two parts:

ECE: this urban cycle represents inner city driving conditions after a cold start with a maximum speed of 50 km/h, and EUDC: the extra-urban driving cycle is typical of suburban and open road driving behavior and includes speeds up to 120 km/h. The data is based on the combined emissions of the ECE and EUDC cycles expressed in g/km. See SAE Papers 961073 and 961068.

Fuel 4 was used as the reference and therefore run in triplicate, all others were run in duplicate. The data represents the average values from the combination of the ECE-EUDC test procedures. ("combined ECE-EUDC" reporting method).

TABLE 4a

| | HC | Delta | NOx | Delta | CO | Delta | PM | Delta |
|---|---|---|---|---|---|---|---|---|
| Fuel 1 | 0.0476 | — 59.7% | 0.567 | — 15.2% | 0.340 | — 53.8% | 0.032 | — 58.4% |
| Fuel 3 | 0.103 | — 12.5% | 0.644 | −3.4% | 0.650 | — 11.6% | 0.076 | -1.5% |
| Fuel 4 | 0.118 | basis | 0.669 | basis | 0.736 | basis | 0.077 | basis |

TABLE 4b

| | HC | Delta | NOx | Delta | CO | Delta | PM | Delta |
|---|---|---|---|---|---|---|---|---|
| Fuel 2 | 0.044 | — 61.7% | 0.519 | — 25.3% | 0.326 | — 55.1% | 0.026 | — 63.2% |
| Fuel 4 | 0.114 | basis | 0.694 | basis | 0.808 | basis | 0.071 | basis |

The data revealed significantly lower emissions produced from applicants wide cut diesel fuels, Fuel 1 and 2, than observed with either of the conventional diesel fuels (Fuels 3 and 4). In particular, Fuel 1 produced emissions with a 59.7% decrease in hydrocarbons, 53.8% decrease in carbon monoxide, 15.2% decrease in nitrogen oxides and 58.4% decrease in particulate matter as compared to the base conventional diesel fuel. Fuel 2 produced emissions with a 61.7% decrease in hydrocarbons, 55.1% decrease in carbon monoxide, 25.3% decrease in nitrogen oxides and 63.2% decrease in particulate matter as compared to the base fuel. However, a closer review of the data shows that the fuel of this invention has a substantial advantage in particulates and nitrogen oxides emissions above that which would be expected. See SAE 961074 and 961075. In this regard, it is well known in the art that the most critical emissions parameter for a diesel fuel is the PM-NOx trade-off, i.e., there is a known inverse relationship between particulate matter and NOx; see SAE 961074 and 961075. Thus, in regard to emissions, decreasing one variable will normally result in increasing the other variable.

Table 5 below details the predicted changes for light duty (i.e., passenger car) diesel engines according to the well recognized European Program on Emissions, Fuels and Engine Technologies (EPEFE) study in Europe undertaken by the government, auto and oil companies to define the relationship between fuel properties and emissions based on variables in density, cetane number and T95. SAE Paper 961073, Tables 3 through 6. The left hand column indicates the two pollutants (particulate matter and nitrogen oxides) along with the changes in absolute emissions in g/Hp-hr and percent change (% increase (positive) or % decrease (negative)) for each of the four fuel characteristics shown at the top of the columns. The emission change (in g/Hp-hr and percent) is based on a deviation of one of the four fuel characteristics as shown in parenthesis. For example, if the T95 were lowered by 55° C., the particulate emissions would decrease by 6.9% while the NOx would increase by 4.6%.

TABLE 5

| | Density (−0.027) | Polyaromatics (−7%) | Cetane (+8 numbers) | T95 (−45° C.) |
|---|---|---|---|---|
| Particulate | | | | |
| g/Hp-hr | −0.012 | −0.003 | 0.003 | −0.004 |
| % | −19.4% | −5.2% | 5.2% | −6.9% |
| NOx | | | | |
| g/Hp-hr | 0.008 | −0.019 | −0.001 | 0.026 |
| % | 1.4% | −3.4% | −0.2% | 4.6% |

Table 6 below was produced by combining the published results of Table 5, with the properties measured in Table 3 and the emissions results of Tables 4a and 4b. The resulting test data indicates the expected change in emissions as projected by the EPEFE equations versus the actual changes measured during emissions testing on each of the fuels listed in Tables 4a and 4b. Again, all results are referenced to Fuel 4 as the base fuel.

TABLE 6

| Pollutant Emissions | | Fuel 3 vs. 4 | Fuel 1 vs. 4 | Fuel 2 vs. 4 |
|---|---|---|---|---|
| Particulate | Projected | −4.1% | −40.9% | −33.4% |
| | Actual | −1.5% | −58.4% | −63.2% |
| NOx | Projected | 1.3% | −2.7% | −4.6% |
| | Actual | −3.4% | −15.2% | −25.3% |

Fuel 3, the conventional fuel, shows very close agreement with the predictions differing by only a slight amount with particulate emissions, 2.4% worse than expected and NOx, 4.6% better than expected. For Fuel 1, the contrast from Fuel 4, the base fuel, is quite different and unexpected. In fact, the wide cut diesel fuels of this invention well exceeded the performance predicted for particulate emissions (Fuel 1: 40.4% above projection [(⁻58.4%−⁻41.6%)/0.416]) while at the same time dramatically decreasing NOx emissions (Fuel 1: 624% above projection [(⁻15.2%−⁻2.1%)/0.021). According to these projections, an improvement in particulate emissions is expected for Fuels 1 and 2 and the above data not only bears this prediction out, but exceeds it. In addition, the EPEFE predictions also predict only a slight decrease in NOx. However, in contrast to this prediction, the data reveals that the diesel fuels of this invention result in a substantial reduction in the NOx emissions above the predicted value. Thus, the diesel fuels of this invention simultaneously result in both large NOx and particulate emissions reductions. Such results are unexpected and directly contradictory to the well-recognized predictions.

Lastly, the wide cut Fischer-Tropsch derived diesel fuel of this invention also displays unusually good smoke results. A standard Bosch smoke test (Bosch T100 free-acceleration smoke test) correlated with startup hydrocarbon emissions and hydrocarbon emissions during hard accelerations was performed using the three comparative fuels from Table 3. The results are in Table 7 below.

TABLE 7

| | |
|---|---|
| Fuel 1: | 0 |
| Fuel 2: | 0.39 |
| Fuel 3: | 2.02 |
| Fuel 4: | 2.07 |

For the wide-cut Fischer-Tropsch derived fuels of this invention, the smoke level was below the detectable amount.

What is claimed is:

1. A fuel, useful as a diesel fuel comprising a Fischer-Tropsch derived hydrocarbon distillate having 338° C.<T90<538° C. and a cold filter plugging point of less than or equal to +5° C.

2. A fuel according to claim 1 wherein the hydrocarbon distillate contains:

<10 wppm Sulfur, Nitrogen

<2 wt % aromatics

<0.1 wt % polyaromatics.

3. Fuel according to claim 1 wherein the hydrocarbon distillate contains:

<5 wppm Sulfur, Nitrogen

<1 wt % aromatics

<0.1 wt % polyaromatics.

4. A fuel according to claim 1 wherein the hydrocarbon distillate contains:

<1 wppm Sulfur, Nitrogen

<wt % aromatics

<0.1 wt % polyaromatics.

5. A fuel according to claim 1 wherein the hydrocarbon distillate has acetane number greater than 65.

6. A method of reducing smoke during operation of a diesel engine comprising combusting a Fischer-Tropsch derived hydrocarbon distillate having a 338° C.<T90<538° C. and containing;

<10 wppm Sulfur, Nitrogen

<2% aromatics

<0.1% polyaromatics wherein the cold filter plugging point of the distillate is less than or equal to +5° C.

7. A method according to claim 6 wherein the hydrocarbon distillate has a having 371° C.<T90<482° C.

8. A method according to claim 6 wherein the hydrocarbon distillate has a having 371° C.<T90<427° C.

9. A method according to claim 6, 7 or 8 wherein the hydrocarbon distillate has a cold filter plugging point of less than or equal to −15° C.

10. A method according to claim 6, 7 or 8 wherein the hydrocarbon distillate has a cold filter plugging point of less than or equal to −30° C.

11. A method according to claim 6 wherein the hydrocarbon distillate contains:

<5 wppm Sulfur, Nitrogen

<1 wt % aromatics

<0.1 wt % polyaromatics and has a cetane number greater than 65.

12. A method according to claim 11 wherein the hydrocarbon distillate contains:

<1 wppm Sulfur, Nitrogen

<0.1 wt % aromatics

<0.1 wt % polyaromatics and has a cetane number greater that 70.

13. A method of making a fuel of claim 1, the method comprising:

(a) passing a 149° C.+ Fischer-Tropsch derived hydrocarbon fraction into a first reaction zone comprising a hydroisomerization catalyst, said Fischer-Tropsch derived hydrocarbon fraction being derive from a Fischer-Tropsch process wherein a synthesis gas feed used in the process comprises a mixture of $H_2$ and CO in a ratio of at least 1.7:1;

(b) hydroisomerizing the 49° C.+ fraction over the hydroisomerization catalyst to form a first effluent;

(c) passing at least a portion of liquid product from the first effluent into a second reaction zone comprising a catalytic dewaxing catalyst;

(d) dewaxing the first effluent over the dewaxing catalyst to form a second effluent; and (e) distilling the second effluent recover a hydrocarbon product with a 338 C.<T90<538° C. and a cold filter plugging point of less than or equal to +5° C.

14. A method according to claim 13 wherein the hydrocarbon distillate contains:

<1 wppm Sulfur, Nitrogen

<0.1 wt % aromatics

<0.1 wt % polyaromatics and has a cetane number greater than 65.

* * * * *